United States Patent [19]

Augis et al.

[11] 4,085,396

[45] Apr. 18, 1978

[54] ELECTRIC FUSE

[75] Inventors: Jacques Armand Augis, Pickerington, Ohio; Ho Sou Chen, Warren; Harry John Leamy, New Providence, both of N.J.

[73] Assignee: Bell Telephone Laboratories, Incorporated, Murray Hill, N.J.

[21] Appl. No.: 726,602

[22] Filed: Sep. 27, 1976

[51] Int. Cl.[2] ..... H01H 85/04

[52] U.S. Cl. ..... 337/290; 337/159

[58] Field of Search ..... 337/290, 165, 159; 252/519; 75/1, 2, 3 K, 170, 159, 153

[56] References Cited

U.S. PATENT DOCUMENTS

| | | | |
|---|---|---|---|
| 2,913,555 | 11/1959 | McAlister | 337/165 |
| 3,427,154 | 2/1969 | Mader et al. | 75/170 |
| 3,747,041 | 7/1973 | Cameron | 337/290 |
| 3,820,040 | 6/1974 | Berry et al. | 75/170 |
| 3,838,365 | 9/1974 | Dutoit | 75/170 |
| 3,856,513 | 12/1974 | Chen et al. | 75/170 |
| 3,940,728 | 2/1976 | Komatsu et al. | 337/290 |

*Primary Examiner*—Harold Broome

*Attorney, Agent, or Firm*—Peter V. D. Wilde

[57] ABSTRACT

An electric fuse is disclosed whose metallic fuse element is in a glassy state. The disclosed fuse is fast-acting and is particularly suited to protect delicate electronic apparatus against current overload.

6 Claims, 2 Drawing Figures

ELECTRIC FUSE

BACKGROUND OF THE INVENTION

1. Field of the Invention

The invention is concerned with electric fuses.

2. Description of the Prior Art

The design of fuses for the protection of electrical circuits against current overload involves consideration of a number of fuse characteristics depending on the type of circuit to be protected. A first fuse characteristic, the so-called current rating, is defined as the strongest current which a fuse will permit to pass indefinitely without blowing. A second fuse characteristic variably known as time lag, clearing time, fusing speed, or simply speed is defined as the time which elapses between the application of a current overload and the blowing of the fuse. The use of a slow fuse, i.e., a fuse with a relatively long time lag, may be indicated in applications such as the protection of electromechanical equipment where short duration switching currents exceeding the current rating of the fuse should leave the fuse intact. A particular design of such a purposely slow fuse is described in "Electric Fuses" by H. W. Baxter, published by Edward Arnold & Co., 1950. The fuse, disclosed by Baxter on pages 38–40 has a current rating of 0.4 A. and can carry a 20 percent current overload for one minute before blowing. While slow fuses may also be useful for the protection of radio sets having large capacitors, the protection of delicate solid state electronic equipment is preferably ensured by fast fuses, i.e., by fuses with fast response to current overload. When comparing fuses it has to be borne in mind that clearing time of a fuse is a function of current overload.

Additional general concerns in the design of fuses are the corrosion resistance of the fuse element and the prevention of arcing between terminals upon fusing of the fuse element. A special concern with the mechanical strength of the fuse element arises with indicating fuses, i.e., fuses in which the fuse element is spring loaded and in which the spring energy, upon blowing of the fuse, becomes available, for example, to close an alarm circuit. Indicating fuses are particularly suited for applications where the quick identification of a blown fuse in a large array of fuses is important; for example, such fuses may be used for protection of complicated equipment such as electronic computers and switching systems.

SUMMARY OF THE INVENTION

By using a metallic fuse element which is in a glassy rather than a polycrystalline state, a fuse is obtained which is fast-acting under current overload. The term metallic is used in this context to indicate a conductive material, and not necessarily a traditional metal composition.

DETAILED DESCRIPTION

Figure 1:
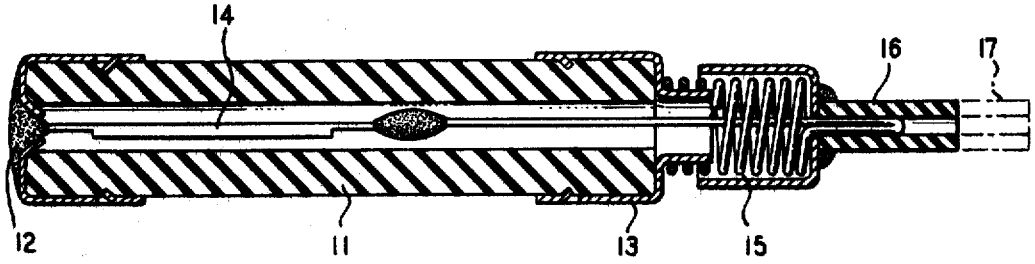
FIG. 1 shows, in cross-section, an indicating fuse having a metallic fuse element which is in a glassy state.

FIG. 1 shows insulating fuse cartridge 11 equipped with electrically conducting end caps 12 and 13 which may serve as fuse terminals. Fuse element 14 is physically and electrically connected to end cap 12, and, via metallic spring 15, to end cap 13. For as long as fuse element 14 is intact, spring 15 is under compression, maintaining fuse element 14 under tensile stress. Upon fusing of fuse element 14 due to current overload between terminals 12 and 13, spring 15 expands, thereby moving alarm activator 16 to alarm position 17.

Figure 2:
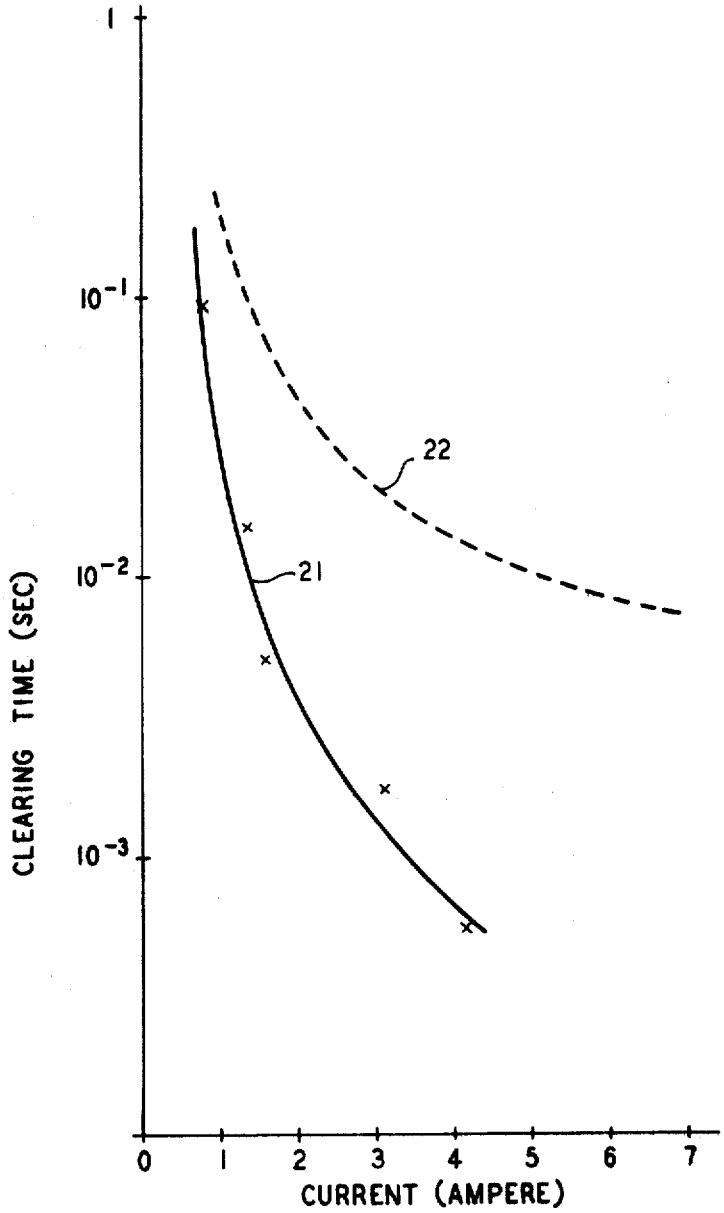
FIG. 2 diagrammatically shows clearing time as a function of electrical current for two fuse elements, one in a polycrystalline state and one in a glassy state.

FIG. 2 shows curve 21 corresponding to a glassy metallic $(Fe_{.4}Ni_{.6})_{75}P_{16}B_6Al_3$ fuse element and curve 22 corresponding to a conventinal polycrystalline $Cu_{55}Ni_{45}$ fuse element, both fuse elements having a current rating of 0.5 A. Curves 21 and 22 graphically show the relationship between clearing time and current flowing through the fuse element. It can be seen from FIG. 2 that at a current of 3 A., i.e., at a current six times the current rating, the glassy metallic fuse element is more than ten times as fast as the polycrystalline fuse element.

It is an essential feature of the invention that the fuse element is a metallic filament which is in a glassy metallic state rather than the more customary polycrystalline metallic state. Among properties which are common to glassy metallic filaments and which make such filaments particularly suited for fuse application, are superior tensile strength at room temperature and precipitous decrease in tensile strength upon heating to a characteristic temperature known as glass transition temperature or fracture temperature. Specifically, due to their high tensile strength, glassy metallic filaments are particularly suited to withstand a spring load when used as fuse elements in indicating fuses. The strength at room temperature of three exemplary glassy alloys and, for the sake of comparison, that of polycrystalline $Cu_{55}Ni_{45}$ wire is shown in Table I.

Due to the drop in strength upon heating to the glass transition temperature, the fuse element will rupture under spring load when heated by current overload. Fusing of a glassy metallic fuse element due to heating to the glass transition temperature is to be contrasted to fusing of a polycrystalline metallic fuse element due to heating to the melting temperature. The greater speed of a fuse equipped with a glassy metallic fuse element is explained by several contributing factors. First, as shown in Table I, the glass transition temperature $T_g$ is substantially lower than the melting temperature $T_m$. Consequently, the amount of heat required to raise the temperature of the fuse element to the glass transition temperature is substantially less than the amount that would be required to raise its temperature to the melting point. Second, once heated to the glass transition temperature, a glassy alloy will rupture under sufficient spring load without any additional heat input; in contrast, melting requires additional heat in the amount of the heat of fusion of the alloy. Finally, a glassy metallic fuse element under spring load does not undergo work hardening during deformation, just prior to fusing. In fact a glassy alloy tends to soften when worked mechanically; consequently, fusing of a glassy filament under spring load is more rapid as compared to fusing of a polycrystalline filament which does undergo hardening upon deformation.

Among alloys which are known to form a glassy state are certain mixtures of metals such as Nb, Ta, Zr, Mo, W, Fe, Co, Ni, Cu, Au, Pd, and Pt selected from the groups of transition metals and noble metals. Mixtures of metals in these groups with metalloids such as Bi, C, Al, Si, P, B, Ge, As, Sn, and Pb or with Be or Mg are also known to form a glassy state. Alloys in the systems $Fe_xNi_{1-x}Y$, where Y is a metalloid or a mixture of metalloids preferably in an amount of from 10–30 atomic percent, are considered to be particularly suited to serve as fuse elements.

Manufacture of glassy metallic filaments may be conveniently carried out by rapid quenching of a melt. For example, H. S. Chen and C. E. Miller in "Centrifugal Spinning of Metallic Glass Filaments", *Materials Research Bulletin,* Vol. 11, pages 49–54, 1976, disclose a process which involves directing a fine stream of the molten alloy against a rotating metallic rim, the surface against which the stream is directd lying on the inside of the rim and having a convex cross-section. Alternate manufacturing apparatus has been disclosed in "A Method of Producing Rapidly Solidified Filamentary Castings" by R. Pond and R. Maddin in *Transactions of the Metallurgical Society of AIME,* Vol. 245, pages 2475–2476, 1969.

To serve as a fuse element the filament may have any conveniently shaped cross section. The cross-sectional area of the filament may be essentially constant over the length of the filament or, as shown in FIG. 1, may advantageously be reduced in two places, preferably near the terminals. This notched design contributes to the prevention of arcing between terminals as follows: Under current overload the fuse element will fuse at one or the other notch rather than at a place where cross-sectional area is greater. If arcing occurs at the point of the fused notch, current overload at the other notch will cause fusing of the filament at the notch also. As a result the section of the filament between notches will become physically detached and arcing will cease. It should be noted that, if a notched design is used, the rating of the fuse depends primarily on the length and cross-sectional area of the notched portions of the filament rather than on its over-all dimensions.

TABLE I

| Composition | State | $T_g$ | $T_m$ | Strength |
|---|---|---|---|---|
| $Pd_{77.5}Cu_6Si_{16.5}$ | glassy | 360° C | 800° C | 180 kg/mm |
| $Cu_{60}Zr_{40}$ | glassy | 400 | 900 | 200 |
| $(Fe_{.4}Ni_{.6})_{75}P_{16}B_6Al_3$ | glassy | 430 | 950 | 250 |
| $Cu_{55}Ni_{45}$ | poly-cryst. | — | 1060 | 45 |

What is claimed is:

1. An electric fuse comprising an elongated metallic fuse element which is electrically connected at its extremities to first and second contact means, characterized in that said fuse element is in an essentially glassy metallic state.

2. Fuse of claim 1 in which said fuse element is spring loaded.

3. Fuse of claim 1 in which said fuse element has essentially constant cross-sectional area.

4. Fuse of claim 1 in which said fuse element has reduced cross-sectional area at at least two points.

5. Fuse of claim 1 in which said fuse element is composed of a mixture of at least a first and a second element, said first element being a transition metal or a noble metal and said second element being a transition metal or a noble metal or a metalloid or Be or Mg.

6. Fuse of claim 5 in which said fuse element is composed of an alloy in the system $Fe_xNi_{1-x}Y$, where Y is a metalloid or a mixture of metalloids in an amount constituting 10–30 atomic percent of the alloy.

* * * * *